US008011286B2

(12) United States Patent
Eagleston

(10) Patent No.: US 8,011,286 B2
(45) Date of Patent: Sep. 6, 2011

(54) FIELD GUN AIM

(75) Inventor: David Andrew Eagleston, Barrow-in-Furness (GB)

(73) Assignee: BAE SYSTEMS plc, London (GB)

( * ) Notice: Subject to any disclaimer, the term of this patent is extended or adjusted under 35 U.S.C. 154(b) by 344 days.

(21) Appl. No.: 12/291,029

(22) Filed: Dec. 16, 2008

(65) Prior Publication Data

US 2009/0260513 A1 Oct. 22, 2009

(30) Foreign Application Priority Data

Dec. 18, 2007 (GB) ..... 0724686.1

(51) Int. Cl.
*F41A 23/00* (2006.01)

(52) U.S. Cl. ..... 89/40.02; 89/37.01; 89/37.07; 89/41.01

(58) Field of Classification Search ..... 89/37.01, 89/37.07, 40.01, 40.02, 40.06, 40.09, 40.11, 89/40.15, 41.01
See application file for complete search history.

(56) References Cited

U.S. PATENT DOCUMENTS 1,403,818 A * 1/1922 Stock ..... 89/40.01
2,407,871 A * 9/1946 Cross ..... 89/41.18
2,467,514 A * 4/1949 Woodman ..... 89/41.18
6,178,866 B1 1/2001 Searle et al.

FOREIGN PATENT DOCUMENTS

EP 128996 A2 * 12/1984 ..... 89/37.01
EP 0 128 996 B1 12/1988
EP 2 138 800 A1 12/2009
GB 2 198 820 A 6/1988
GB 2 313178 A 11/1997
GB 2 455 652 A 6/2009

* cited by examiner

*Primary Examiner* — Michael Carone
*Assistant Examiner* — Gabriel J Klein
(74) *Attorney, Agent, or Firm* — Scully, Scott, Murphy & Presser, P.C.

(57) ABSTRACT

A howitzer suitable for deployment on a ground plane, the howitzer comprising a barrel for firing a projectile, the barrel defining a barrel axis and having a muzzle towards the front end of the howitzer and a breech towards the back end of the howitzer; a cradle for holding the barrel at an azimuth and an elevation; a recoil accommodating mechanism such that the barrel can move along the barrel axis relative to the cradle; a bearing for varying the azimuth of the cannon; and a linkage for varying the elevation of the bearing.

10 Claims, 5 Drawing Sheets

FIELD GUN AIM

The following invention relates to a howitzer and particularly to a mechanism for varying the elevation and azimuth of a cannon in a howitzer.

The cannon is the component of the howitzer that launches the projectile. It comprises a barrel and a cradle.

In known howitzers (such as the L118 Light Gun that fires 105 mm rounds) the cannon is aimed (i.e. has azimuth or elevation varied) using a saddle and soleplate arrangement. In such typical howitzers the soleplate is a plate-like platform that sits on the ground so as to bear the weight of the Gun and oppose any forward tipping moments; forward tipping moments are greatest during counter recoil. The soleplate is provided with a saddle mounted on top. The soleplate and saddle are connected by a swivel joint, thus the saddle can swivel in the plane of the ground (e.g. when the ground is horizontal, the saddle will swivel in a horizontal plane) so as to vary the cannon azimuth. The saddle is connected to the cannon by way of trunnions that extend laterally from the cannon, thus the cannon can rotate about the trunnion/saddle connection to vary the elevation.

In use, such howitzers rest on the ground with the cannon having a breech end towards the back of the howitzer and a muzzle end pointing in a generally forwards direction. The foremost point of contact between the howitzer and the ground (the foremost ground contact point) lies at an edge of the soleplate and is below the cannon and substantially forwards of the howitzer's centre of gravity. However the trunnions lie backward of the swivel joint and towards the breech of the cannon. Because the saddle and soleplate arrangement extends between the foremost ground contact point and the trunnions, it defines a structure that approximates to being perpendicular to the barrel axis. Consequently, the distance between the trunnions and the foremost ground contact point effects a moment arm. The soleplate and saddle arrangement provides support for the cannon and so, disadvantageously, high bending moments are induced in the soleplate, saddle and associated joints when the cannon fires a projectile, particularly during recoil. Thus the soleplate, saddle and joints must be sufficiently robust to withstand these forces. Such robust designs tend to add weight to the soleplate, saddle and joints.

It is known that howitzers are desired to be lightweight. Lightweight howitzers are desirable because they can be transported by a wider range of vehicles and because a greater number of them may be carried by a given transport vehicle. Thus lightweight howitzers can be deployed faster than heavier alternatives.

GB2313178 discloses a lightweight howitzer that is suitable for firing 155 mm rounds. In this invention, the counter-recoil tipping moments of the cannon are not reacted by a soleplate and saddle arrangement alone, but also by forward trail legs which rest on the ground. The trunnions are located close to the ground along the axis of the recoiling barrel to reduce the moment arm of the saddle and trail legs, thus minimising bending moments upon recoil. However, having a trunnion close to the floor and also on the axis of recoil makes the breech less accessible. This is because the breech must be offset from the trunnion along the line of recoil so as to allow the barrel to recoil fully without striking either the cradle or the ground. The extended cradle that supports the breech in this offset position obstructs the operator's access to the breech. Further, the height of the breech changes considerably from one elevation to another due to the greater radius from the trunnions. Such an inaccessible breech increases load time and requires the provision of a specially tailored ram.

It is an object of the present invention to provide a howitzer that firstly has an aiming mechanism that accommodates the firing forces to minimize the bending stresses induced in the gun components and that secondly has a breech that is easily accessible by the operating crew.

According to the invention there is provided a howitzer suitable for deployment on a ground plane, the howitzer comprising: a barrel for firing a projectile, the barrel defining a barrel axis and having a muzzle towards the front end of the howitzer and a breech towards the back end of the howitzer; a cradle for holding the barrel at an azimuth and an elevation; a bearing for varying the azimuth of the cannon; and a linkage mechanism for varying the elevation of the bearing.

By elevating the component which effects the azimuth variation (i.e. the bearing), there is no need for the component that varies the elevation to be mounted on the bearing. The absence of such a component (e.g. the saddle in the Light Gun) enables the bearing to connect to the cradle of the cannon at a much reduced separation. This reduces the moment arm and so reduces the bending stresses induced in the cannon support components.

A further advantage is that it allows the breech to be close to the trunnions and bearing so that as the elevation changes, the height of the breech does not change considerably and so the breech remains consistently accessible. This makes operation of the gun easier and so can tend to increase firing rates.

Preferably the linkage mechanism further comprises: a pivot body into which the bearing is mounted, the pivot body rotating about a trunnion axis so as to vary the elevation of the bearing; a front leg for contacting the ground at a foremost contact point; a first pivotable joint connecting the front leg to the pivot body; a back leg for contacting the ground at a backmost contact point; and a second pivotable joint connecting the back leg to the pivot body, Advantageously this linkage enables the spacing between the backmost and foremost ground contacting point to be generally constant as the barrel, bearing and cradle elevate. Thus if the ground spacing is sufficient to react all counter-recoil tipping moments at zero elevation, the bearing can be elevated without fear of transforming the howitzer into a configuration where the howitzer is prone to toppling.

Preferably the trunnion axis is defined by the second pivotable joint.

Preferably the first pivotable joint is positioned forward of the second pivotable joint such that when the pivot body rotates so as to vary the elevation of the bearing, the front leg counter rotates relative to the pivot body.

Preferably the front leg comprises a front lug extending generally upwards from the first pivotable joint, and the back leg comprises a back lug extending generally upwards from the second pivotable joint, and the howitzer further comprises a link pivotally connected at one end to the front lug and pivotally connected at the other end to the back lug.

The positioning of the pivotable joints on the pivot body and the provision of the link connecting the lugs creates a mechanism whereby as the pivot body elevates in a first rotational direction, the front leg rotates in a second rotational direction opposite to the first rotational direction. Thus the back leg is inclined to the ground at a constant angle.

Preferably the howitzer comprises: a back leg comprising an elongate member; a back leg axis defined by the elongate member; and an azimuth swivel plane defined by the bearing and the bearing axis of rotation, wherein the back leg axis can intersect the azimuth swivel plane over a range of intersection angles, such that at the midpoint of the range, the back leg axis is generally within the azimuth swivel plane.

This advantageously means that when the barrel is aiming at the midpoint of its elevation range, the barrel axis is aligned with the back leg axis and so recoil forces are channelled directly into the ground. Thus the bending stresses are minimised because the moment arm is substantially eliminated. Further to this, even when the barrel is elevated away from the midpoint of its elevation range, there will be a substantial vector component of the back leg aligned with the barrel which will transfer forces to the ground.

In particular preference the range is approximately 70°.

Advantageously, this range allows the barrel to have a considerable elevation range, but even at the extremities of this range, the barrel is only inclined to the back leg, at most by 35°.

Preferably the front leg extends to rest on the ground at a foremost ground contact point and the back leg extends to rest on the ground at a backmost ground contact point such that the foremost ground contact point is situated below the barrel and substantially forwards of the howitzer's centre of gravity so as to be able to oppose the tipping moment induced during counter-recoil.

Beneficially the front legs and back legs are therefore at the periphery of the howitzer's ground base and so they alone can oppose the forces that the howitzer experiences during firing so that the howitzer does not topple. The legs can be the only structures in contact with the ground.

Preferably the front leg is provided with an extension mechanism such that the front leg extends as the bearing elevates.

Advantageously, this allows the ground contact point of the back leg and the ground contact point of the front leg to have a generally constant separation (referred to as constant pitch) as the barrel elevates.

Preferably the front leg further comprises a sleeve, one end of which connects to the pivot body at the first pivotable joint, and an arm slidable within the sleeve; wherein the howitzer further comprises a compensating linkage pivotally connected to the pivot body at a first linkage end and pivotally connected to the arm at the second linkage end, such that the first linkage end is located backward of the first pivotable joint.

Advantageously, this allows the bearing to elevate, maintains constant pitch and effects the extension automatically as the rotation occurs, this automation is effected by the mechanical linkage and so need not require electronic actuation which may unnecessarily add weight and tend to increase complexity.

Preferably the howitzer further comprises an actuator connected between the pivot body and the front leg, for varying the elevation of the bearing.

Advantageously this means that the variation of the elevation can be effected by simply actuating one component.

An exemplary embodiment of the invention now will be described with reference to the following figures, of which:

Figure 1:
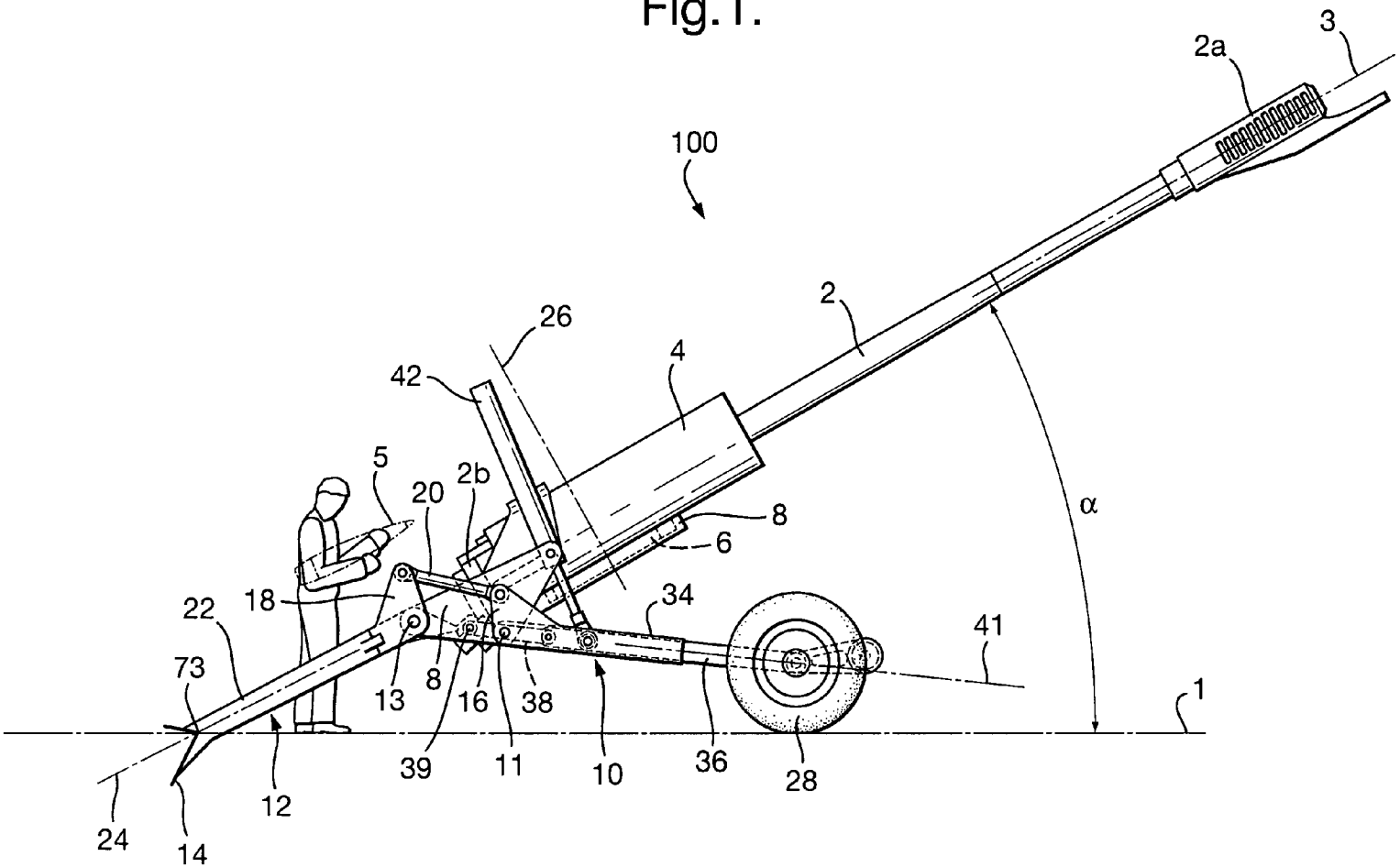
FIG. 1 shows a side elevation of an exemplary howitzer resting on a ground plane, the barrel of the howitzer is held at a first elevation.
Figure 2:
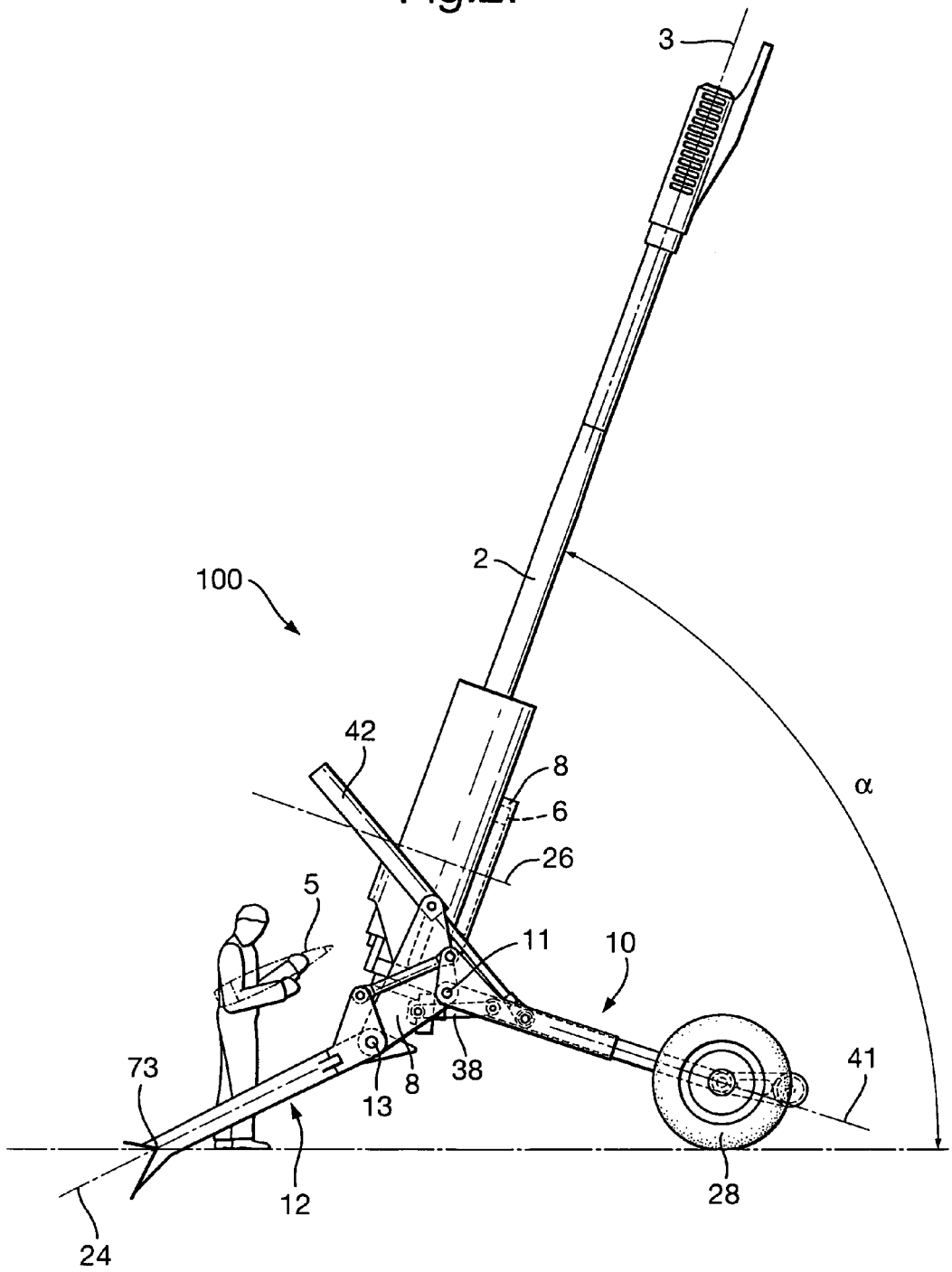
FIG. 2 shows the howitzer of FIG. 1, the barrel of the howitzer is held at a second elevation greater than the first.
Figure 3:
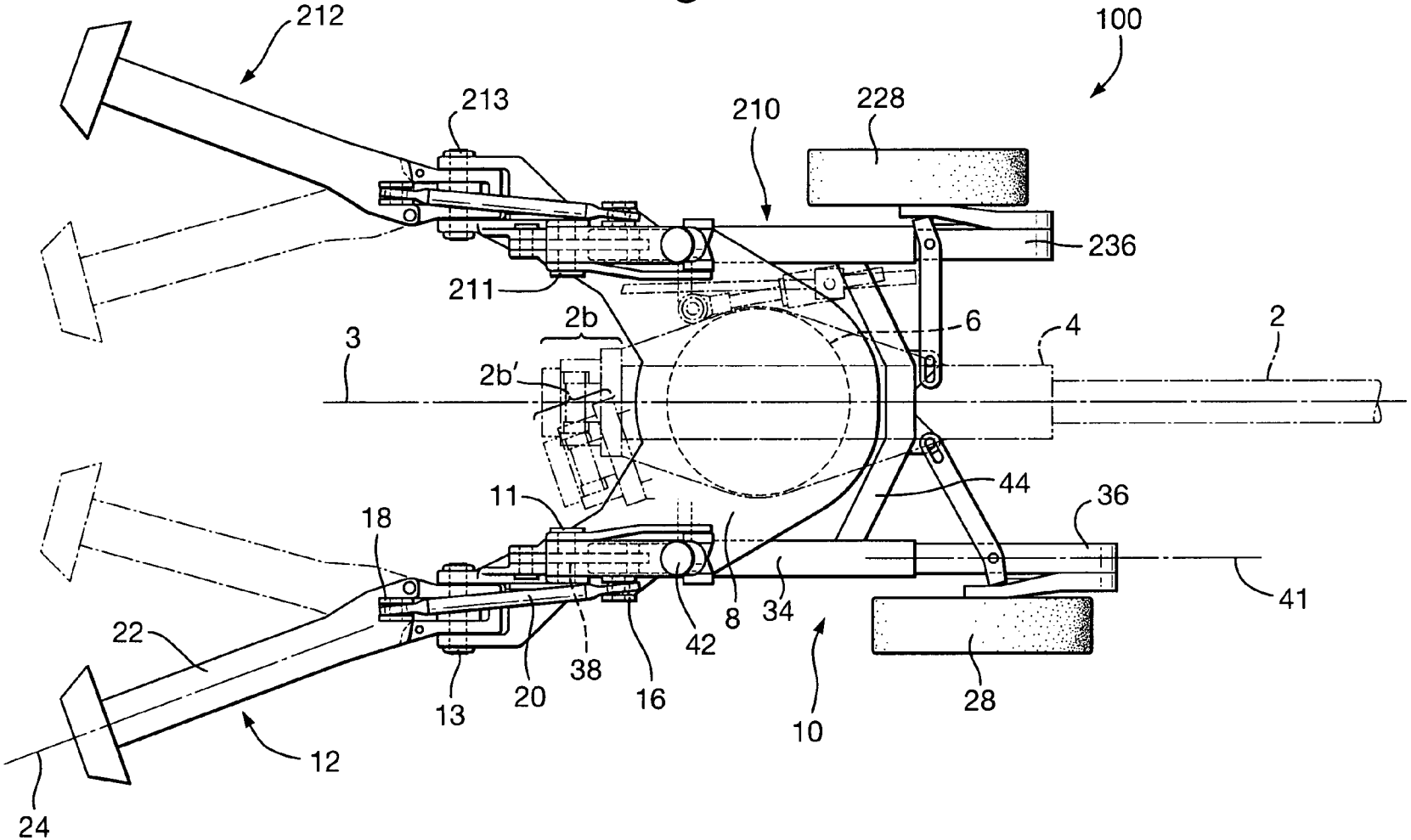
FIG. 3 shows a top down view of the howitzer of FIG. 1 held at an elevation of zero degrees.

Referring particularly to FIGS. 1, 2 and 3, the howitzer indicated generally at 100 is to be described. A gun barrel 2 is shown that defines a barrel axis 3. Barrel 2 has a muzzle end 2*a* and a breech end 2*b*. This barrel 2 is inclined to a ground plane 1 by a certain elevation $\alpha$ and is inclined to the plane of the paper at a certain azimuth. In FIG. 1, the certain elevation is approximately 35° and the certain azimuth is zero. In FIG. 2 the elevation is approximately 70° and the certain azimuth is zero. In FIG. 3, the elevation is 0° and the azimuth is zero.

The barrel 2 is held in position by a cradle 4 which surrounds the axis of the barrel 2 at the breech end 2*b*. The cradle 4 is provided with a recoil mechanism (not shown) so that when a 155 mm calibre projectile 5 is fired, the barrel 2 can move backwards through the cradle 4 along the barrel axis 3, the recoil mechanism also reacting against the ejection of the projectile 5.

The cradle 4 is connected to a pivot body 8 by a bearing 6. More specifically, a rotor component (not shown) of the bearing 6 is fixed to the cradle 4 and a stator component (not shown) of the bearing 6 is fixed to the pivot body 8. Thus the Cradle 4, and hence the barrel 2 that the cradle 4 holds, are able to swivel relative to the pivot body 8 about a bearing axis of rotation 26 and in an azimuth swivel plane. Thus the azimuth of the barrel can be varied.

Figure 4:
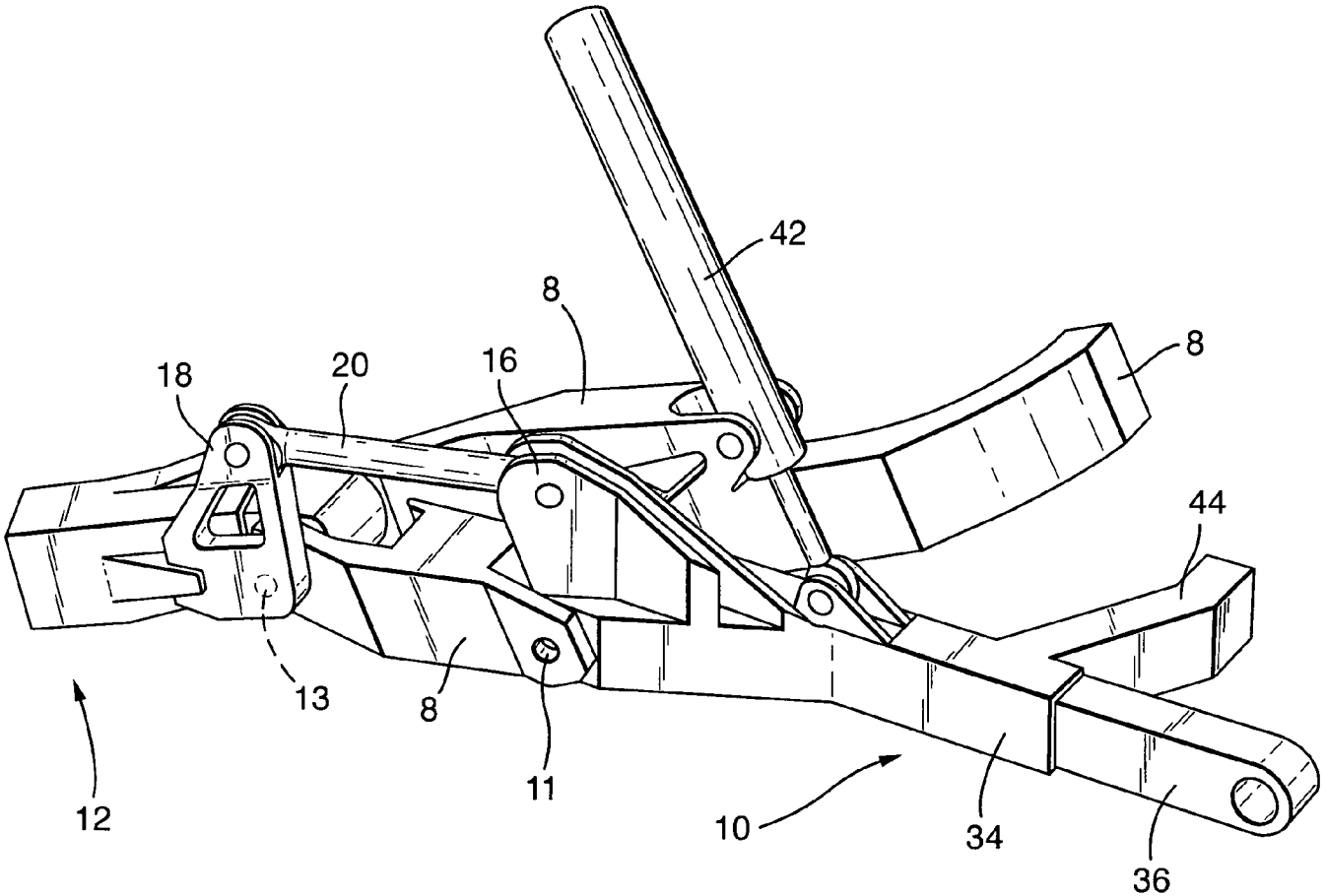
FIG. 4 shows a first geometric view of one suitable linkage for varying the elevation of a bearing in addition to a connecting end of the front leg and a connecting end of the back leg.
Figure 5:
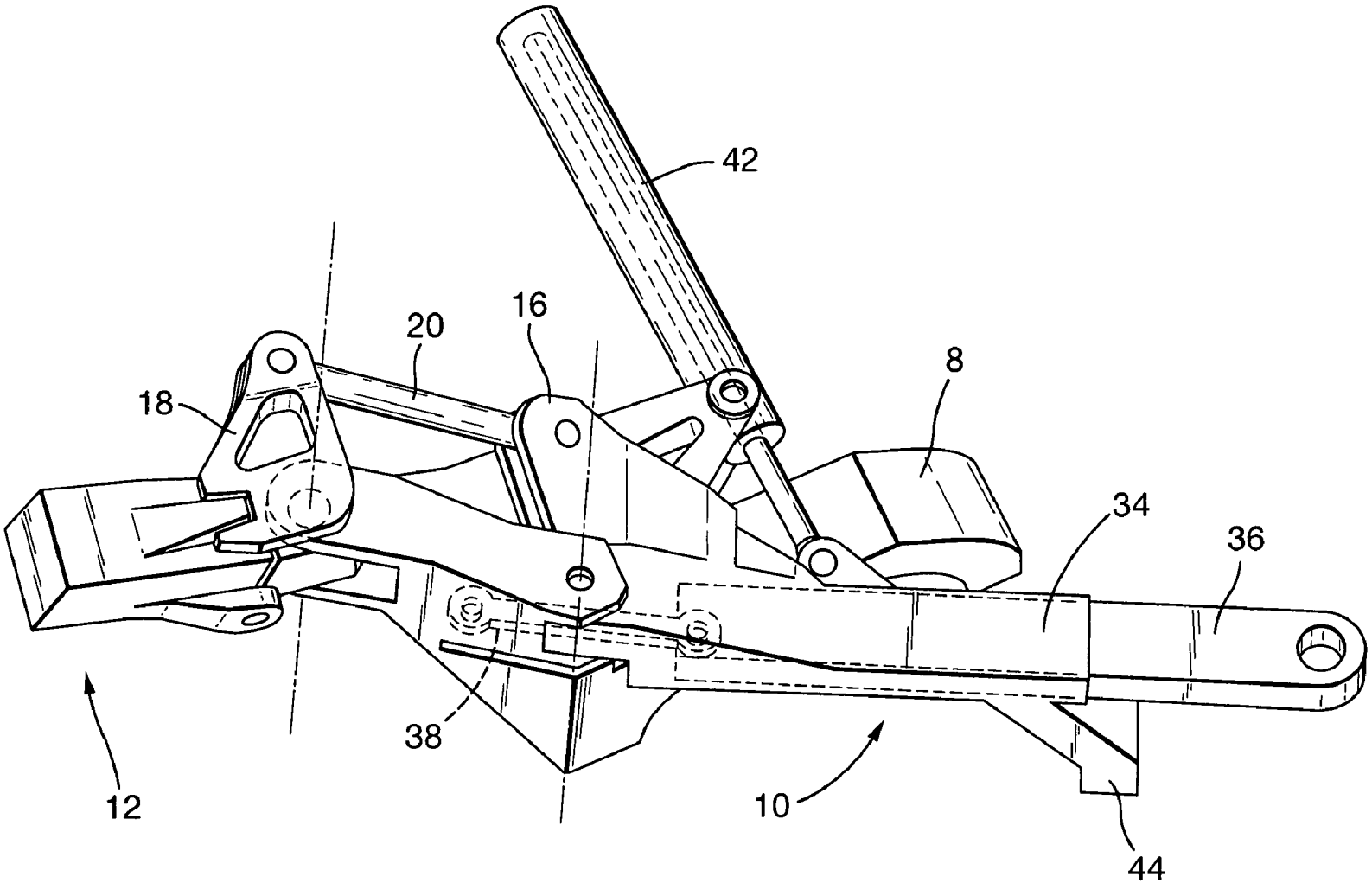
FIG. 5 shows a geometric wireframe view of the linkage of FIG. 3 in addition to a connecting end of the front leg and a connecting end of the back leg.

Referring additionally to FIGS. 4 and 5, Pivot body 8 is connected to a component of front leg 10 by a first pivotable joint 11 and is connected to a back leg 12 by a second pivotable joint 13. On the opposite side of the howitzer 100 to that shown in FIGS. 1, 2, 4 and 5 is a second front leg 210 connected to the pivot body 8 by another pivotable joint 211, and a second back leg 212 connected to the pivot body 8 by yet another pivotable joint 213. Front legs 210 and 10 are rigidly connected with bracing 44.

Since the howitzer 106 is generally symmetrical about its centre line and the mechanism for elevating the barrel is identical on the nearside (front leg 11 back leg 12) and the far side (front leg 210 and back leg 212), only the nearside mechanism will be described. The description is equally applicable to the equivalent far side components.

Pivot body 8 is also provided with a pivot joint 39 for connecting to a first end of a compensating linkage 38.

First pivotable joint 11 is forward of second pivotable joint 13. That is to say, first pivotable joint 11 is closer to a foremost ground contact point 28 (where front leg 10 contacts the ground) than the second pivotable joint 13. Pivot joint 39 lies between the first 11 and second 13 pivotable joints.

Front leg 10 defines a front leg axis 41 and comprises a sleeve 34 arranged coaxially with an arm 36. The sleeve 34 and the arm 36 are slidably connected; a portion of the arm 36 is within the sleeve 34. The sleeve 34 is the component of the front leg 10 that is connected to the first pivotable joint 11. The sleeve 34 of the front leg 10 is rigidly connected to the sleeve of the opposite front leg 210 by brace 44 so as to form an H-shaped stanchion. The arm 36 is pivotally connected, towards its backmost end, to the compensating linkage 38 at the second linkage end. The arm 36 extends to rest on the ground 1 at the foremost ground contact point 28.

An actuator 42 in the form of a selectively expandable bar has a first and a second end. A point between these ends is pivotally connected to the pivot body 8 and so forms a pivot joint on the pivot body 8 that is both foremost and uppermost relative to the other pivot joints. The second end of actuator 42 is pivotally connected to the sleeve 34 of the front leg 10.

The front leg 10 further comprises a front lug 16 extending upwards from the first pivotable joint 11 (i.e. the front lug 16 extends away from the ground). The front lug 16 is pivotally connected to a first end of a link 20. A corresponding back lug 18, positioned on the back leg 12 and extending upwards from a second pivotable joint 13 (i.e. the back lug 18 extends away from the ground), is connected to a second end of the link 20.

The back leg 12 comprises an elongate member 22 that extends downwards and backwards from the second pivotable joint 13 to a surface for contacting the ground 14 (such as a spade). Back leg 12 contacts the ground at the back most ground contact point 73. The elongate member 22 defines a back leg axis 24.

In FIG. 3 the far side foremost ground contact point 228 is positioned on a retracted arm 236 and the nearside wheel foremost ground contact point 28 is positioned on an extended arm 36. This illustrates the range of movement possible as the arms slide forward of sleeves.

Also visible in FIG. 3 is the varying position of the breech as it occupies a first azimuth filing position 2*b* (aligned with the centre line of the gun) and second azimuth firing position 2*b*' (at an extremity of the azimuth range). All positioning of the breech are easily accessible from the back of the gun.

In order to increase the elevation, the actuator (which in this embodiment is a hydraulic ram and cylinder) expands. Back leg 12 remains at generally the same inclination. This causes the pivot body 8 to rotate about the axis of the second pivotable joint 13 (the trunnion axis) so as to elevate the bearing 6. As the pivot body 8 rotates in a first direction, the front leg 10 is forced by the link 20 to rotate in the opposite direction.

The link 20 pushes on the front lug 16 as pivot body 8 increases the bearing elevation. The resulting rotation of the front leg 10 increases the angle of incidence between the front leg axis 41 and the ground plane 1. To maintain the pitch between the backmost 73 and foremost 28 ground contacting points, an extension mechanism extends the front leg 10.

The elevation of the bearing 6 and the extension of the front leg 10 are simultaneous. The extension occurs because the arm 36 slides forwards relative to the sleeve 34. This extension is actuated by the compensating link 38 that forces the arm 34 down the sleeve 36 as the pivot body 8 rotates anti-clockwise about the second pivotable joint 13.

Alternatively, elevation is reduced by compressing actuator 42. As the bearing elevation is reduced, the link 20 pulls on the front lug 16 so as to reduce the angle of incidence angle of incidence between the front leg axis 41 and the ground plane 1. Simultaneously, the compensating link 38 tends to retract the arm 36 back into the sleeve 34.

This simultaneous extension and elevation increase (or conversely, the simultaneous retraction and elevation reduction) tends to keep the location of the foremost ground contact point 28 constant as the elevation varies. This does away with the need to detach and reattach front leg 10 to the ground 1 between firing the gun at different elevations. Manual adjustments of the front leg 10 are therefore minimised or eliminated during aiming.

The components of the howitzer are fabricated from materials which are able to withstand the peak stresses and the cyclic loads that will be experienced in operation. In relation to this, the form of the components will be chosen according to the same criteria. The materials and forms will be chosen to minimise weight without compromising the strength. Given this, various steel alloys, titanium alloys and composites may, for example, be suitable materials. The man skilled in the art of howitzer design would be able to decide which materials and forms would be best in the circumstances.

Whilst the example described above relates specifically to a 155 mm calibre round, the invention is in no way limited to any particular calibre. For example, a howitzer according to this invention could be for firing 105 mm rounds.

Whilst the example described above relates to a towed howitzer, the invention is equally applicable to self propelled howitzers. In such variants, the front legs and back legs would not necessarily contact the ground but could be mounted on a surface of the self propelling howitzer chassis.

Further, it is envisaged that howitzers within the scope of the claims of the present invention may be constructed so as to be apt for disassembly and re-assembly. Such an aptitude would enable the howitzer to be transported by an even wider range of transport vehicles and further, would allow for worn out parts to be replaced individually without taking the entire howitzer out of service.

Further variants within the scope of the invention would be obvious to the skilled man.

The invention claimed is:

1. A howitzer suitable for deployment on a ground plane, the howitzer comprising:

i) a cannon comprising a) a barrel for firing a projectile, the barrel defining a barrel axis and having a muzzle towards the front end of the howitzer and a breech towards the back end of the howitzer;

b) a cradle for holding the barrel at an azimuth and an elevation;

ii) a bearing for varying the azimuth of the cannon; and iii) a linkage for varying the elevation of the bearing, the linkage further comprising:

a pivot body into which the bearing is mounted, the pivot body rotating about a trunnion axis so as to vary the elevation of the bearing;

a front leg;

a first pivotable joint directly connecting the front leg to the pivot body on a side thereof;

a back leg; and a second pivotable joint directly connecting the back leg to the pivot body on said side thereof.

2. A howitzer according to claim 1 wherein the trunnion axis is defined by the second pivotable joint.

3. A howitzer according to claim 1 wherein the first pivotable joint is positioned forward of the second pivotable joint such that when the pivot body rotates so as to vary the elevation of the bearing, the front leg counter-rotates relative to the pivot body.

4. A howitzer according to claim 3 wherein:

the front leg comprises a front lug extending generally upwards from the first pivotable joint; and the back leg comprises a back lug extending generally upwards from the second pivotable joint;

and the howitzer further comprises a link pivotally connected at one end to the front lug and pivotally connected at the other end to the back lug.

5. A howitzer according to claim 1 comprising:

a back leg comprising an elongate member;

a back leg axis defined by the elongate member; and an azimuth swivel plane defined by the bearing and the bearing axis of rotation, wherein the back leg axis can intersect the azimuth swivel plane over a range of intersection angles, such that at the midpoint of the range, the back leg axis is generally within the azimuth swivel plane.

6. A howitzer according to claim 5 wherein the range is approximately 70 degrees.

7. A howitzer according to claim 1 wherein the front leg extends to rest on the ground at a foremost ground contact point and the back leg extends to rest on the ground at a backmost ground contact point such that the foremost ground contact point is situated below the barrel and substantially forwards of the howitzer's centre of gravity so as to be able to oppose the tipping moment induced during counter-recoil.

8. A howitzer according to claim 1 wherein the front leg is provided with an extension mechanism such that the front leg extends as the bearing elevates.

9. A howitzer according to claim 8 wherein the front leg further comprises:

a sleeve, one end of which connects to the pivot body at the first pivotable joint, and an arm slidable within the sleeve, wherein the howitzer further comprises:

a compensating linkage pivotally connected to the pivot body at a first linkage end and pivotally connected to the arm at the second linkage end, such that the first linkage end is located backward of the first pivotable joint.

10. A howitzer according to claim 1 further comprising;

an actuator, pivotally connected to the pivot body and the front leg, for varying the elevation of the bearing.

* * * * *